US011309143B2

(12) United States Patent
Miyamoto et al.

(10) Patent No.: US 11,309,143 B2
(45) Date of Patent: Apr. 19, 2022

(54) PUSH SWITCH

(71) Applicant: ALPS ALPINE CO., LTD., Tokyo (JP)

(72) Inventors: Junichi Miyamoto, Miyagi (JP); Toshiaki Mizukoshi, Miyagi (JP); Akizumi Saito, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/104,561

(22) Filed: Nov. 25, 2020

(65) Prior Publication Data

US 2021/0082640 A1 Mar. 18, 2021

Related U.S. Application Data

(63) Continuation of application No. PCT/JP2019/008665, filed on Mar. 5, 2019.

(30) Foreign Application Priority Data

May 29, 2018 (JP) ..... JP2018-102641

(51) Int. Cl.
*H01H 13/14* (2006.01)
*H01H 13/20* (2006.01)
(Continued)

(52) U.S. Cl.
CPC ..... *H01H 13/14* (2013.01); *H01H 13/20* (2013.01); *H01H 13/52* (2013.01); *H01H 13/04* (2013.01)

(58) Field of Classification Search
CPC ..... H01H 13/14; H01H 13/20; H01H 13/52; H01H 13/04; H01H 5/30; H01H 2227/03; H01H 2215/004; H01H 2227/022
(Continued)

(56) References Cited

U.S. PATENT DOCUMENTS 7,109,431 B2 * 9/2006 Yanai ..... H01H 13/14 200/341
7,217,893 B1 * 5/2007 Huang ..... H01H 13/48 200/1 B
(Continued)

FOREIGN PATENT DOCUMENTS

JP S61-123425 U 8/1986
JP H02-106643 U 8/1990
(Continued)

OTHER PUBLICATIONS

International Search Report for PCT/JP2019/008665 dated May 28, 2019.

*Primary Examiner* — Lheiren Mae A Caroc
(74) *Attorney, Agent, or Firm* — IPUSA, PLLC

(57) ABSTRACT

A push switch including a pressing member, a movable contact, an interposed member, a first fixed contact, and a second fixed contact is provided. The pressing member includes a pressing portion configured to be pressed, and includes an elastically deformable peripheral wall portion having a lower end portion and extending downward and outward from the outer periphery of the pressing portion. The movable contact has a dome shape and is disposed below the pressing member. The interposed member is disposed between the pressing member and the movable contact, and is configured to press the movable contact by receiving and being pressed by the lower end portion of the peripheral wall portion of the pressing member. The lower end portion of the peripheral wall portion of the pressing member presses the interposed member while the peripheral wall portion is subjected to elastic deformation in response to the pressing portion being pressed.

7 Claims, 7 Drawing Sheets

(51) Int. Cl.
*H01H 13/52* (2006.01)
*H01H 13/04* (2006.01)

(58) Field of Classification Search
USPC .... 200/302.2, 341, 520, 402, 405, 406, 408, 200/409, 516
See application file for complete search history.

(56) References Cited

U.S. PATENT DOCUMENTS

| | | | | |
|---|---|---|---|---|
| 2013/0032457 | A1* | 2/2013 | Quinn | H01H 13/32 200/341 |
| 2021/0210292 | A1* | 7/2021 | Kobayashi | H01H 13/26 |

FOREIGN PATENT DOCUMENTS

| | | |
|---|---|---|
| JP | H02-123029 U | 10/1990 |
| JP | 2003-346599 | 12/2003 |
| WO | 2009/096404 | 8/2009 |

* cited by examiner

PUSH SWITCH

CROSS-REFERENCE TO RELATED APPLICATIONS

This application is a continuation of International Application No. PCT/JP2019/008665, filed on Mar. 5, 2019 and designating the U.S., which claims priority to Japanese Patent Application No. JP2018-102641 filed on May 29, 2018. The contents of these applications are incorporated herein by reference in their entirety.

BACKGROUND OF THE INVENTION

1. Field of the Invention

The disclosures herein relate to a push switch.

2. Description of the Related Art

Conventionally, push switches are used in various types of electronic devices. Such a push switch employs a technique that can provide a pressing sensation to an operator when the operator presses a pressing member by causing the pressing member to elastically deform and applying an operation load during the pressing operation. Such a push switch also employs a technique that can provide a clicking sensation to the operator by causing the pressing member to press a dome-shaped movable contact such that the movable contact becomes inverted.

For example, Patent Document 1 below describes an input apparatus that includes a rubber spring. The rubber spring includes a pressing portion having a protruding portion that protrudes downward, and leg portions integrally formed with the pressing portion. In the input apparatus, when the pressing portion is pressed, the leg portions bend, thereby causing the protruding portion to press the upper surface of a dome-shaped movable contact. As a result, the movable contact becomes inverted and contacts a fixed contact. In this manner, the input apparatus is turned on.

However, in Patent Document 1, the movable contact is disposed within the space of the rubber spring. Therefore, in Patent Document 1, as the size of the rubber spring decreases along with the size reduction of the input apparatus, the size of the movable contact may also need to be reduced. Thus, it may be difficult to provide a favorable clicking sensation.

RELATED-ART DOCUMENTS

Patent Documents

Patent Document 1: WO2009/096404

SUMMARY OF THE INVENTION

According to one embodiment, a push switch including a pressing member, a movable contact, an interposed member, a first fixed contact, and a second fixed contact is provided. The pressing member includes a pressing portion configured to be pressed, and includes an elastically deformable peripheral wall portion having a lower end portion and extending downward and outward from the outer periphery of the pressing portion. The movable contact has a dome shape and is disposed below the pressing member. The interposed member is disposed between the pressing member and the movable contact, and is configured to press the movable contact by receiving and being pressed by the lower end portion of the peripheral wall portion of the pressing member. The first fixed contact is provided in contact with the movable contact. The second fixed contact is configured to be contacted with and separated from the movable contact. The lower end portion of the peripheral wall portion of the pressing member presses the interposed member while the peripheral wall portion is subjected to elastic deformation in response to the pressing portion being pressed.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

Figure 1:
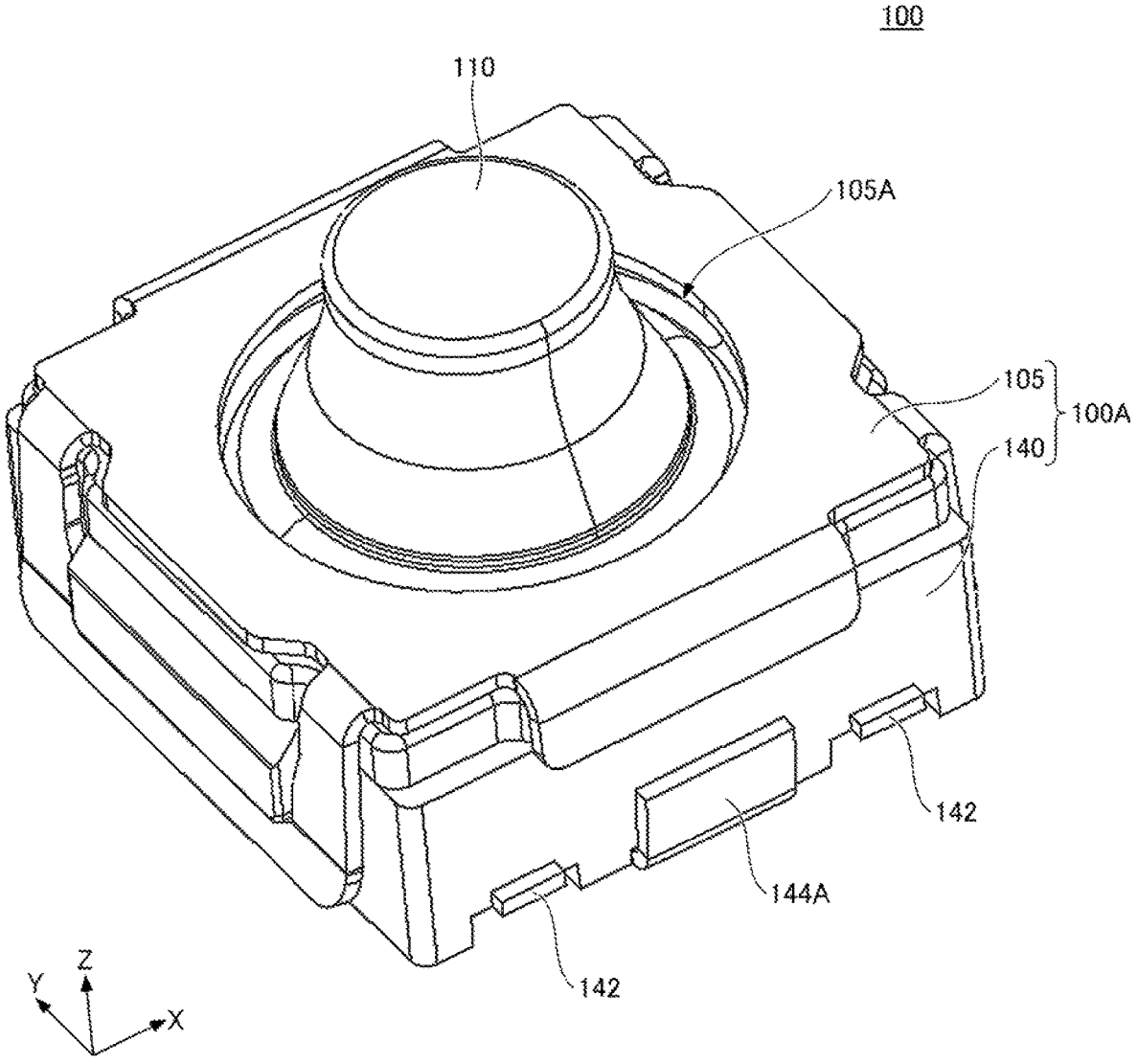
FIG. 1 is a perspective view of an external appearance of a push switch according to an embodiment.

According to one embodiment, a small push switch capable of providing a favorable operation sensation can be provided.

In the following, embodiments of the present invention will be described with reference to accompanying drawings. In the drawings, the positive Z-side is referred to as an upper side, and the negative Z-side is referred to as a lower side for the sake of convenience.

(Overview of Push Switch 100)

FIG. 1 is a perspective view of an external appearance of a push switch 100 according to an embodiment. As illustrated in FIG. 1, the push switch 100 includes a casing 100A having a rectangular parallelepiped shape. The casing 100A includes a housing 140 and a frame 105. The frame 105 is attached to the top of the housing 140. The frame 105 of the housing 100A has a circular opening 105A, and a rubber stem 110 protrudes above the opening 105A. The push switch 100 can switch between an off-state and an on-state by pressing the rubber stem 110 down. Specifically, in a state in which the rubber stem 110 is not pressed, the push switch 100 is in the off-state, and a first fixed contact 142 and a second fixed contact 144 provided in the housing 140 are not electrically connected to each other. Conversely, pressing the rubber stem 110 down causes the push switch 100 to be in the on-state, and in this on-state, the first fixed contact 142 and the second fixed contact 144 are electrically connected to each other. When the rubber stem 110 is released from being pressed, the rubber stem 110 is subjected to an elastic return force and automatically returns to the initial state. As a result, the push switch 100 automatically returns to the off state.

(Configuration of Push Switch 100)

Figure 2:
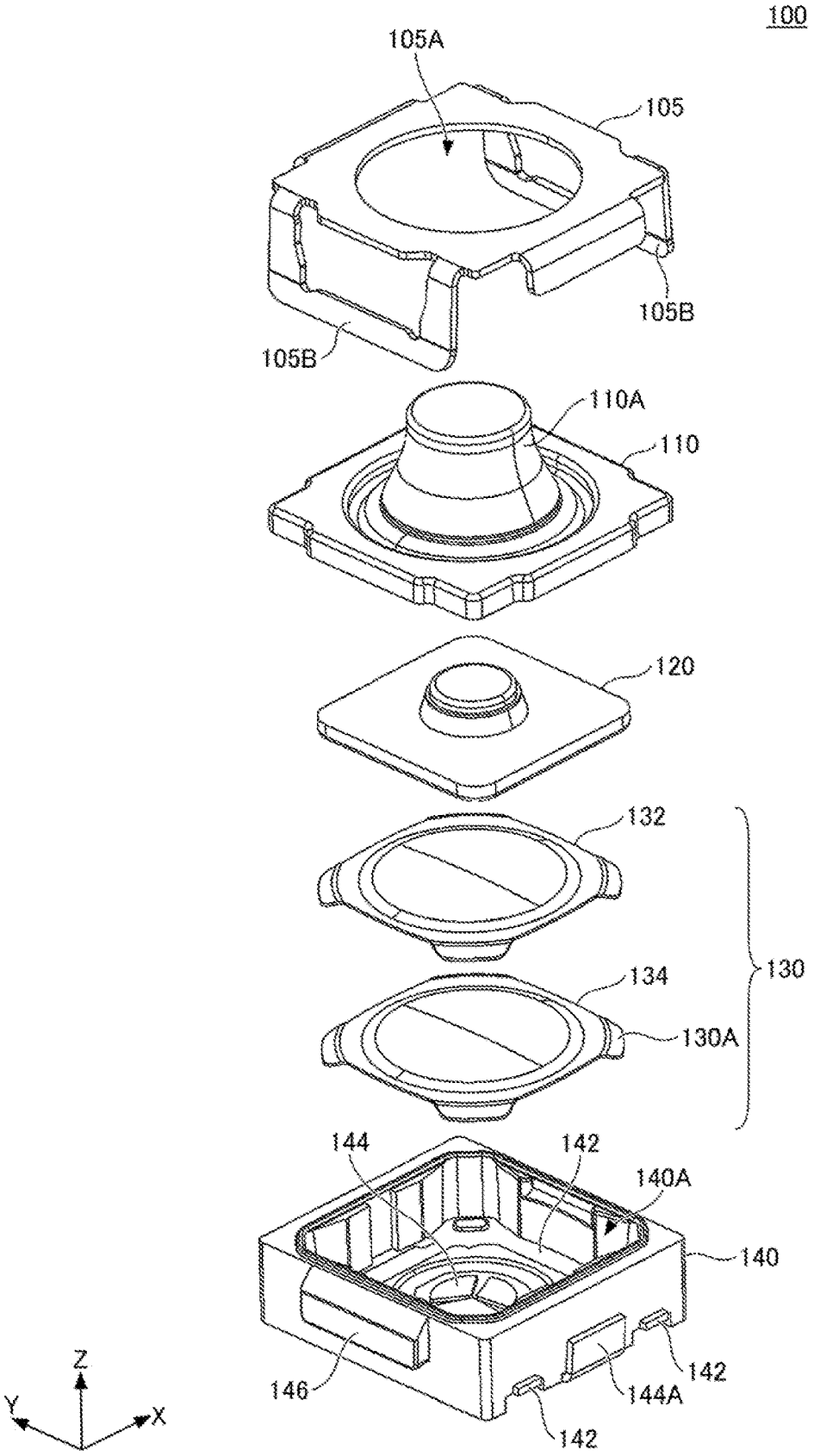
FIG. 2 is an exploded perspective view of the push switch according to the embodiment.
Figure 3:
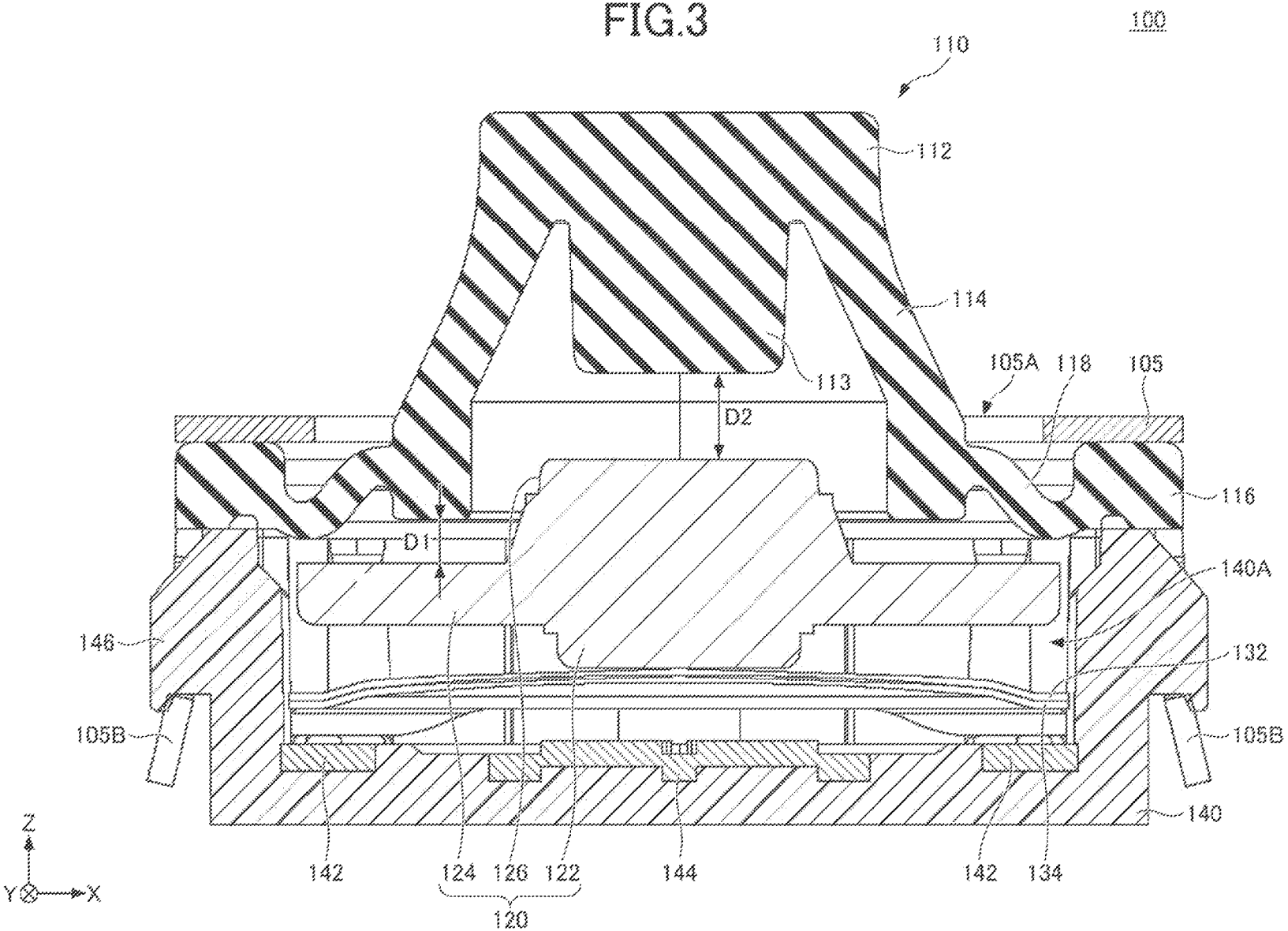
FIG. 3 is a cross-sectional view of the push switch according to the embodiment taken along the XZ plane.
Figure 4:
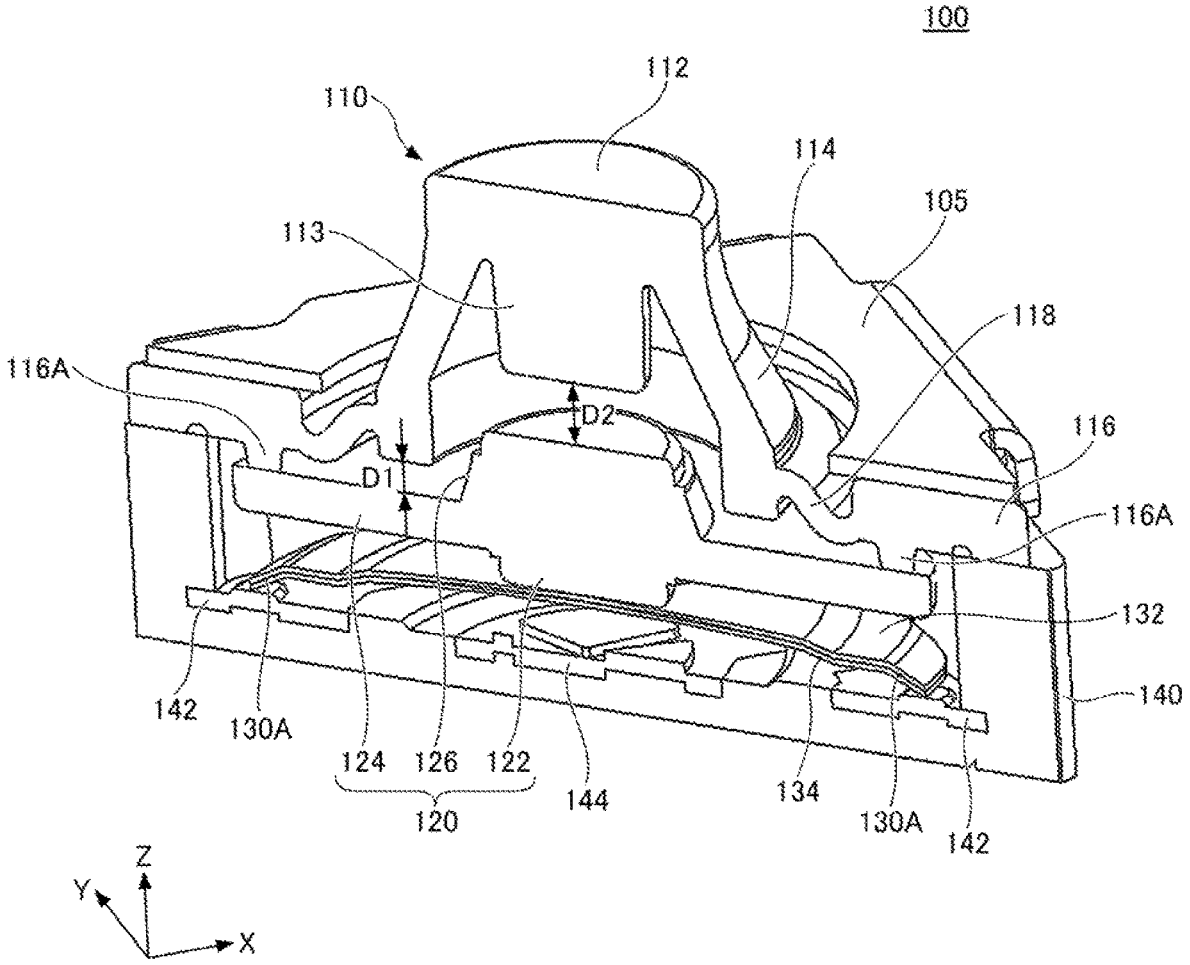
FIG. 4 is a perspective cross-sectional view of the push switch according to the embodiment.

FIG. 2 is an exploded perspective view of the push switch 100 according to the embodiment. FIG. 3 is a cross-sectional view of the push switch 100 according to the embodiment taken along the XZ plane. FIG. 4 is a perspective cross-sectional view of the push switch 100 according to the embodiment.

As illustrated in FIG. 2, the push switch 100 includes the frame 105, the rubber stem 110, an inner stem 120, a metal contact 130, and the housing 140.

The frame 105 is a flat plate-shaped member that is attached to the top of the housing 140, and constitutes the casing 100A together with the housing 140. The rubber stem 110 is sandwiched between the frame 105 and the housing 140. The rubber stem 110 is disposed on the upper portion of the housing 140 so as to close a housing space 140A by fixedly attaching the frame 105 to the top of the housing 140, with the components (the inner stem 120 and the metal contact 130) being housed in the housing space 140A of the housing 140. For example, the frame 105 is formed by processing a metal plate. The frame 105 has the circular opening 105A through which the rubber stem 110 protrudes upward. Further, hooks 105B that extend downward are formed on the outer peripheral edges, parallel to the Y-axis, of the frame 105. The hooks 105B have openings, and connecting portions 146 formed on the side surfaces of the housing 140 fit into the openings of the hooks 105B. In this manner, the hooks 105B fixes the frame 105 to the housing 140.

The rubber stem 110 is an example of a "pressing member", and is configured to be pressed down by an operator. The rubber stem 110 is provided below the frame 105. As illustrated in FIG. 3, the rubber stem 110 includes a pressing portion 112 and a peripheral wall portion 114. The pressing portion 112 has a circular shape as viewed from the top, and is configured to be pressed by the operator. The peripheral wall portion 114 has a skirt shape, and extends downward and outward from the outer periphery of the pressing portion 112. The pressing portion 112 and the peripheral wall portion 114 pass through the opening 105A of the frame 105, and protrude above the frame 105. Accordingly, the pressing portion 112 of the rubber stem 110 can be pressed down by the operator from above the frame 105. For example, the rubber stem 110 is formed of an elastic material (such as silicone or rubber).

When a pressing operation is performed for the pressing portion 112, the bottom surface of the peripheral wall portion 114 contacts the inner stem 120, causing the peripheral wall portion 114 to elastically deform. The elastic deformation of the peripheral wall portion 114 causes the pressing portion 112 to sink downward while applying an operation load during the pressing operation. Note that when the operation load exceeds a predetermined level, the peripheral wall portion 114 can deform such that the skirt shape of the peripheral wall portion 114 rapidly changes. That is, the peripheral wall portion 114 can be inverted. A protruding portion 113 is provided at the center of the lower surface the pressing portion 112. The protruding portion 113 protrudes downward (into a space surrounded by the peripheral wall portion 114). When the pressing portion 112 sinks downward, the protruding portion 113 contacts the upper surface of an upper protruding portion 126 that protrudes upward from the center of the inner stem 120, and presses the inner stem 120 downward.

The rubber stem 110 includes a fixed frame portion 116 and a support portion 118. The fixed frame portion 116 and the support portion 118 are provided outside the outer periphery of the peripheral wall portion 114. The fixed frame portion 116 is a frame-shaped portion that surrounds the outer periphery of the peripheral wall portion 114 and is spaced apart from the outer periphery of the peripheral wall portion 114. The fixed frame portion 116 is sandwiched between the frame 105 and the housing 140. The support portion 118 is a flange-shaped portion that couples the outer periphery of the peripheral wall portion 114 to the fixed frame portion 116. Upon pressing the pressing portion 112, the support portion 118 elastically deforms, thereby allowing the peripheral wall portion 114 to be moved downward. As illustrated in FIG. 3, when the pressing portion 112 is not pressed, the bottom surface of the peripheral wall portion 114 is spaced apart from the upper surface of the inner stem 120 (a flange portion 124). Upon pressing the pressing portion 112, the support portion 118 elastically deforms, thereby causing the peripheral wall portion 114 to be moved downward until the bottom surface of the peripheral wall portion 114 contacts the upper surface of the inner stem 120, and this is defined as a "pre-stroke". During this time, the elastic deformation of the support portion 118 allows an operation load required to press the pressing portion 112 to gradually increase.

The inner stem 120 is an example of an "interposed member." The inner stem 120 is interposed between the rubber stem 110 and the metal contact 130. The inner stem 120 receives the bottom surface of the peripheral wall portion 114 of the rubber stem 110 and the bottom surface of the pressing portion 112 (protruding portion 113) of the rubber stem 110. Upon the top of the inner stem 120 being pressed by the rubber stem 110, the inner stem 120 presses the top of the metal contact 130, and causes the metal contact 130 to deform. The inner stem 120 includes a lower protruding portion 122, the flange portion 124, and the upper protruding portion 126. The flange portion 124 is a horizontal disk-shaped portion. The lower protruding portion 122 is an approximately cylindrical portion that protrudes downward from the center of the flange portion 124. The upper protruding portion 126 is an approximately cylindrical portion that protrudes upward from the center of the flange portion 124. In a state in which the rubber stem 110 is not pressed, the bottom surface of the lower protruding portion 122 of the inner stem 120 contacts the top of the metal contact 130, and the upper surface of the flange portion 124 contacts projecting portions 116A that project from the fixed frame portion 116 of the rubber stem 110. When the rubber stem 110 is pressed, the bottom surface of the peripheral wall portion 114 contacts the upper surface of the flange portion 124 first, and the pressing force from the bottom surface of the peripheral wall portion 114 causes the top of the metal contact 130 to be pressed. When the rubber stem 110 is further pressed, the bottom surface of the protruding portion 113 of the rubber stem 110 contacts the upper surface of the upper protruding portion 126. As a result, the pressing force from the bottom surface of the peripheral wall portion 114 and the pressing force from the bottom surface of the protruding portion 113 cause the top of the metal contact 130 to be further pressed.

The metal contact 130 is an example of a "movable contact", and is provided below the inner stem 120. The metal contact 130 is a dome-shaped member formed of a metal plate. Tongue portions 130A are formed at the four corners of the metal contact 130. The tongue portions 130A protrude outward and are curved downward. As illustrated in FIG. 4, the metal contact 130 is electrically connected to the first fixed contact 142 by causing the tongue portions 130A to contact the first fixed contact 142 provided in the housing 140. When the rubber stem 110 is pressed, the top (center) of the metal contact 130 is pressed downward by the inner stem 120. Then, when the operation load reaches a predetermined level, the top of the metal contact 130 rapidly deforms into the shape of a recess (that is, the metal contact 130 is inverted). As a result, the bottom side of the top of the metal contact 130 contacts the second fixed contact 144 provided in the housing 140, and the metal contact 130 is electrically connected to the second fixed contact 144. Because the metal contact 130 has a spring characteristic, the metal contact 130 returns to the initial projected shape by a repulsive force when the metal contact 130 is released from the pressing force applied from the inner stem 120. In the present embodiment, the metal contact 130 has a stacked structure in which two metal plates 132 and 134 having the same shape are stacked. Accordingly, in the metal contact 130, the operation load can be adjusted to provide a suitable clicking sensation.

The load characteristics (the relationship between the operating stroke and the load) of the rubber stem 110 are compared with the load characteristics of the metal contact 130. First, the load required for the metal contact 130 is larger than that of the rubber stem 110, and the metal contact 130 is less deformable than the rubber stem 110. That is, if the same pressing force is applied to the rubber stem 110 and the metal contact 130, the rubber stem 110 tends to deform first. Further, when comparing the inversion of the rubber stem 110 with the inversion of the metal contact 130, the metal contact 130 inverts more rapidly. Therefore, the metal contact 130 can provide a sharper clicking sensation. In the case of the rubber stem 110, the peripheral wall portion 114 is inverted after the peripheral wall portion 114 deforms and protrudes outward. Therefore, the rubber stem 110 can provide a softer clicking sensation than the metal contact 130.

The housing 140 is a container member having a rectangular parallelepiped shape. The open-top housing space 140A is formed in the housing 140. The inner stem 120 and the metal contact 130 are housed in the housing space 140A. For example, the housing 140 may be formed of a relatively rigid insulating material (such as a rigid resin). The connecting portions 146 that protrude outward are formed on the side surfaces, parallel to the Y-axis, of the housing 140. When the frame 105 is attached to the top of the housing 140, the connecting portions 146 engages with the hooks 105B of the frame 105. In this manner, the frame 105 is fixed to the housing 140.

The first fixed contact 142 and the second fixed contact 144 are provided at the bottom of the housing space 140A. The first fixed contact 142 is provided along the peripheral edge of the bottom of the housing space 140A. The first fixed contact 142 is electrically connected to the metal contact 130 by making contact with the tongue portions 130A of the metal contact 130. The second fixed contact 144 is provided at the center of the bottom of the housing space 140A. The second fixed contact 144 is electrically connected to the metal contact 130 by making contact with the center of the metal contact 130 (that is, the bottom side of the top of the metal contact 130), and is electrically connected to the first fixed contact 142 via the metal contact 130. For example, each of the first fixed contact 142 and the second fixed contact 144 may be formed by processing a metal plate. As illustrated in FIG. 1 and FIG. 2, an exposed portion 144A is formed on the side surface on the negative Y-axis side (parallel to the X-axis) of the housing 140. The exposed portion 144A is formed by bending a part (a part protruding outward from the side surface on the negative Y-axis side) of the metal plate, integrally forming the second fixed contact 144, upward. In addition, although not illustrated, an exposed portion 142A is formed on the side surface on the positive Y-axis side (parallel to the X-axis) of the housing 140. The exposed portion 142A is formed by bending a part (a part protruding outward from the side surface on the positive Y-axis side) of the metal plate, integrally forming the first fixed contact 142, upward. The exposed portion 142A and the exposed portion 144A have the same shape, and function as external terminals that can be electrically connected to external wiring or the like.

Figure 5:
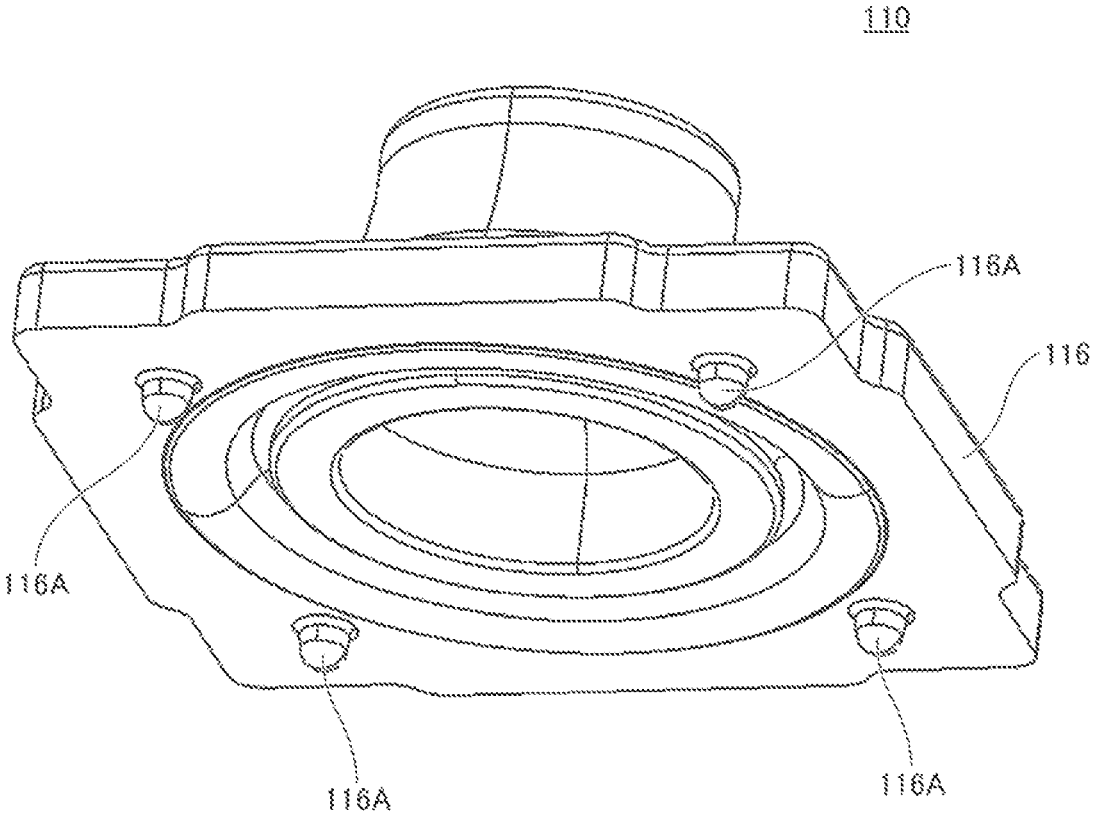
FIG. 5 is a perspective view of a rubber stem, as viewed from the bottom side, according to the embodiment.

FIG. 5 is a perspective view of the rubber stem 110, as viewed from the bottom side, according to the embodiment. As illustrated in FIG. 5, the projecting portions 116A that project downward are provided at the four corners of the bottom surface of the fixed frame portion 116 of the rubber stem 110. The projecting portions 116A contact the upper surface of the flange portion 124 of the inner stem 120, and press the inner stem 120 against the metal contact 130, thereby causing the inner stem 120 to be fixed within the housing space 140A while maintaining a predetermined distance D1 between the flange portion 124 of the inner stem 120 and the peripheral wall portion 114 of the rubber stem 110 (see FIG. 3 and FIG. 4). The distance D1 defines the amount of downward movement of the peripheral wall portion 114 immediately after a pressing operation is performed. That is, the distance D1 defines the amount of a pre-stroke of the pressing operation. The distance D1 is less than a distance D2 between the protruding portion 113 of the rubber stem 110 and the upper protruding portion 126 of the inner stem 120. Accordingly, when the pressing operation is performed, the peripheral wall portion 114 contacts the flange portion 124 before the protruding portion 113 contacts the upper protruding portion 126.

(Operation and Load Characteristics of Push Switch 100)

FIGS. 6A through 6D are diagrams illustrating the operation of the push switch 100 according to the embodiment. FIG. 7 is a graph indicating load characteristics of the push switch 100 according to the embodiment.

Figure 6A:
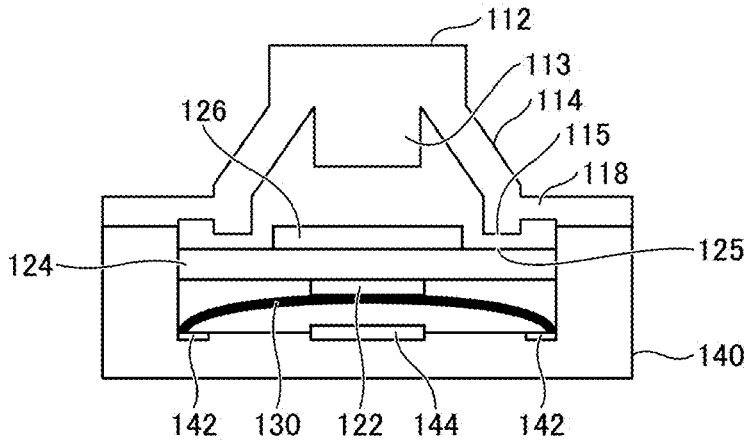
FIGS. 6A through 6D are diagrams illustrating the operation of the push switch according to the embodiment.
Figure 7:
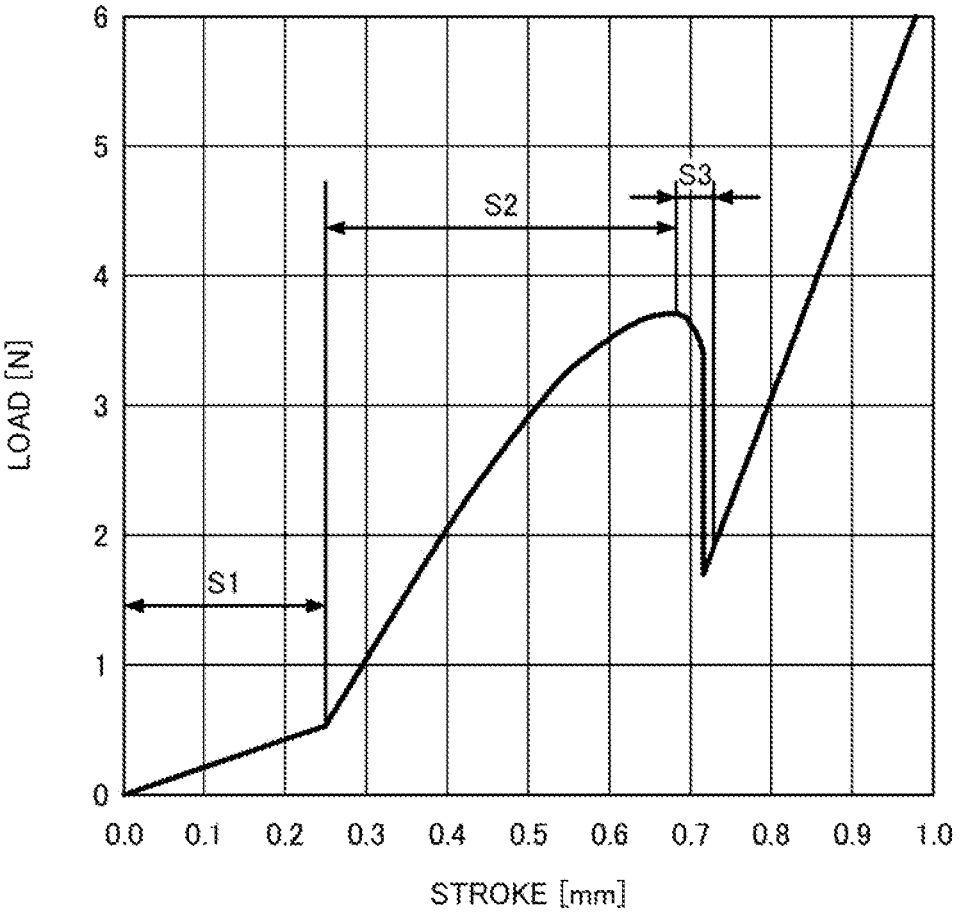
FIG. 7 is a graph indicating load characteristics of the push switch according to the embodiment.

FIG. 6A depicts a state in which the pressing portion 112 is not pressed. In this state, the distance D1 is maintained between the bottom surface (lower end portion) 115 of the peripheral wall portion 114 and the upper surface (contact portion) 125 of the flange portion 124.

Figure 6B:
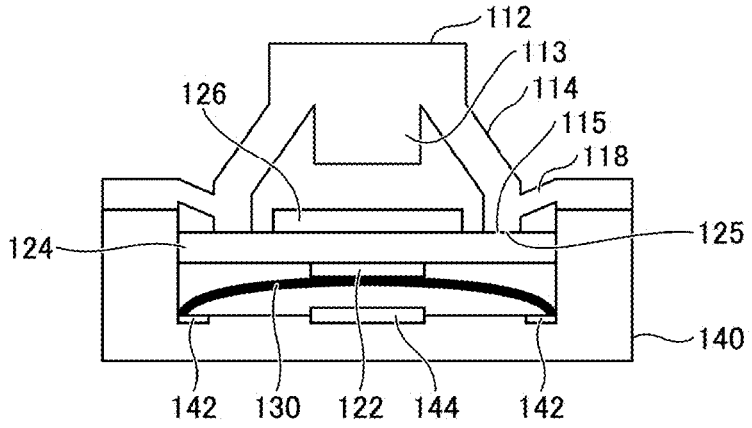

As illustrated in FIG. 6B, when the pressing portion 112 starts to be pressed down, the support portion 118, supporting the outer periphery of the peripheral wall portion 114, elastically deforms, thereby causing the peripheral wall portion 114 to be moved downward until the bottom surface (lower end portion) 115 of the peripheral wall portion 114 contacts the upper surface (contact portion) 125 of the flange portion 124, and this is defined as a "pre-stroke". During this time, as indicated in section S1 of FIG. 7, the elastic deformation of the support portion 118 allows an operation load required to press the pressing portion 112 to gradually increase at a constant rate of increase.

Figure 6C:
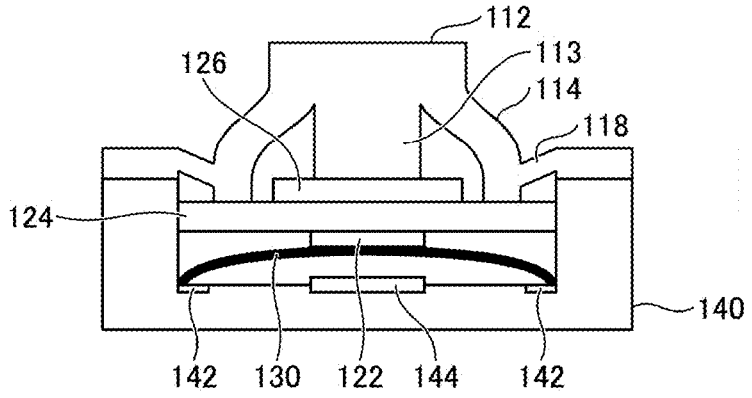

Next, as illustrated in FIG. 6C, upon the pressing portion 112 being further pressed down, with the bottom surface of the peripheral wall portion 114 contacting the upper surface of the flange portion 124, the peripheral wall portion 114 elastically deforms so as to protrude outward while pressing the inner stem 120 downward. As a result, the pressing portion 112 sinks downward. Then, the bottom surface of the protruding portion 113 contacts the upper surface of the upper protruding portion 126 before the peripheral wall portion 114 is inverted. Therefore, the downward sinking of the pressing portion 112 against the peripheral wall portion 114 is restricted, and the peripheral wall portion 114 is prevented from being inverted. During this time, as indicated in section S2 of FIG. 7, the elastic deformation of the peripheral wall portion 114 causes the operation load required to press the pressing portion 112 to increase such that the amount of increase in the operation load per unit operation amount gradually decreases. In the section S2, the peripheral wall portion 114 presses the inner stem 120 downward. However, because the rubber stem 110 is more deformable than the metal contact 130, the rubber stem 110 (in particular, the peripheral wall portion 114) dominates in terms of the load characteristics in the section S2. That is, when the operating stroke is relatively small, the peripheral wall portion 114 resists the pressing force, and the operation load thus rapidly increases. When the operating stroke is relatively large, the peripheral wall portion 114 can no longer resist the pressing force and deforms so as to protrude outward, and the operation load thus gradually increases. Accordingly, a softer pressing sensation can be provided to the operator.

As illustrated in FIG. 7, the load characteristics of the push switch 100 differs between the section S1, in which the peripheral wall portion 114 is moved downward, and the section S2 in which the peripheral wall portion 114 elastically deforms. Accordingly, a gradual pressing sensation can be provided to the operator.

Figure 6D:
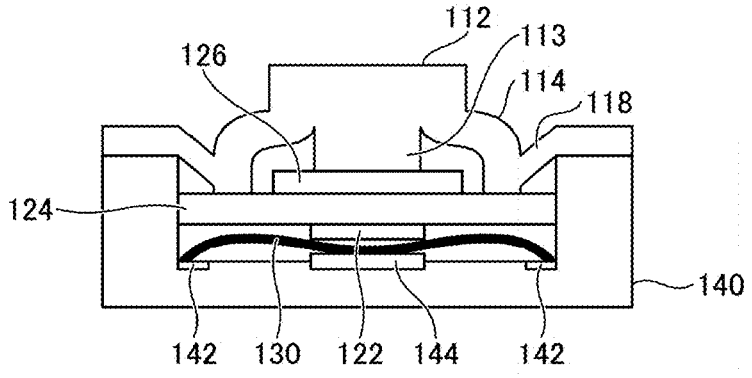

As illustrated in FIG. 6D, upon the pressing portion 112 being further pressed down with the bottom surface of the protruding portion 113 contacting the upper surface of the flange portion 124, each of the peripheral wall portion 114 and the protruding portion 113 elastically deforms, and the protruding portion 113 presses the inner stem 120 downward. At this time, the elastically deformable amount of the rubber stem 110 (such as the pressing portion 112 and the peripheral wall portion 114) gradually decrease, and the extent to which the inner stem 120 is pressed gradually strengthens. Then, the pressing force applied from the inner stem 120 causes the metal contact 130 to be rapidly inverted such that the top of the metal contact 130 deforms into the shape of a recess. As a result, the center of the metal contact 130 contacts the second fixed contact 144, and the first fixed contact 142 and the second fixed contact 144 are electrically connected to each other via the metal contact 130. As illustrated in FIG. 7, the operation load rapidly decreases in section S3 because there are small elastically deformable portions in the rubber stem 110 and the metal contact 130 is inverted. That is, the metal contact 130 dominates in terms of the load characteristics in the section S3. Accordingly, a sharp clicking sensation can be provided to the operator.

As described above, in the push switch 100 according to the embodiment, the inner stem 120 provided between the rubber stem 110 and the metal contact 130 receives the bottom surface of the peripheral wall portion 114 of the rubber stem 110, and presses the top of the metal contact 130. Accordingly, in the push switch 100 according to the embodiment, the metal contact 130 is not required to be placed within the space of the rubber stem 110. Therefore, the metal contact 130 larger than the space of the rubber stem 110 can be employed, and a favorable clicking sensation can be provided.

In particular, in the push switch 100 according to the embodiment, the bottom surface of the peripheral wall portion 114 presses the inner stem 120 while the peripheral wall portion 114 elastically deforms. Accordingly, in the push switch 100 according to the embodiment, the operation load required for the pressing operation can be gradually increased, and a favorable pressing sensation can be provided.

The push switch 100 according to the embodiment that is compact and is capable of providing a favorable operation sensation can be provided.

In addition, in the push switch 100 according to the embodiment, the rubber stem 110 has load characteristics in which elastic deformation of the peripheral wall portion 114 causes the operation load to increase such that the amount of increase in the operation load per unit operation amount gradually decreases. Accordingly, in the push switch 100 according to the embodiment, when the operating stroke is relatively small, the operation load required for the pressing operation rapidly increases, and when the operating stroke is relatively large, the operation load required for the pressing operation gradually increases. As a result, a softer pressing sensation can be provided to the operator.

Further, in the push switch 100 according to the embodiment, the support portion 118 of the rubber stem 110 allows the peripheral wall portion 114 to be vertically movable. In addition, when the pressing portion 112 is not pressed, the bottom surface of the peripheral wall portion 114 is spaced apart from the upper surface of the inner stem 120 (flange portion 124). Accordingly, in the push switch 100 according to the embodiment, upon pressing the pressing portion 112, the peripheral wall portion 114 is moved downward until the bottom surface of the peripheral wall portion 114 contacts the inner stem 120, which is defined as a "pre-stroke". During this time, the elastic deformation of the support portion 118 allows a relatively small operation load to be applied. That is, the push switch 100 according to the embodiment can switch the load characteristics at a timing where the bottom surface of the peripheral wall portion 114 contacts the inner stem 120. As a result, a gradual pressing sensation can be provided to the operator.

Further, in the push switch 100 according to the embodiment, the inner stem 120 includes the flange portion 124 that receives the bottom surface of the peripheral wall portion 114, and includes the lower protruding portion 122 that protrudes downward from the center of the flange portion 124. Therefore, in the push switch 100 according to the embodiment, the pressing force applied from the bottom surface of the peripheral wall portion 114 can be concentrated on the lower protruding portion 122. As a result, the lower protruding portion 122 can efficiently and securely press the top of the metal contact 130.

Further, in the push switch 100 according to the embodiment, the rubber stem 110 includes the elastically deformable protruding portion 113 that protrudes downward from the pressing portion 112 and that is surrounded by the peripheral wall portion 114. When the peripheral wall portion 114 elastically deforms, the protruding portion 113 is moved downward, and the inner stem 120 (the upper protruding portion 126) receives the protruding portion 113 before the peripheral wall portion 114 is inverted. Accordingly, in the push switch 100 according to the embodiment, a rapid decrease in an operation load due to the inversion of the peripheral wall portion 114 in the middle of a pressing operation (that is, in the middle of the operation load being increased by the elastic deformation of the peripheral wall portion 114) can be prevented. As a result, a softer pressing sensation can be provided to the operator.

Further, in the push switch 100 according to the embodiment, the metal contact 130 is inverted and contacts the second fixed contact 144 when the inner stem 120 is being pressed by both the bottom surface of the peripheral wall portion 114 and the bottom surface of the protruding portion 113. Accordingly, in the push switch 100 according to the embodiment, the operation load can be rapidly decreased when the operation load is gradually increasing. As a result, the push switch 100 can provide a soft pressing sensation while also providing a sharp clicking sensation.

Although specific embodiments have been described above, the present invention is not limited to the particulars of the described embodiments, and modifications and variations may be made without departing from the scope of the present invention.

For example, in the above-described embodiments, a pre-stroke is provided by maintaining the distance D1 between the bottom surface of the peripheral wall portion 114 and the upper surface of the flange portion 124 in a state in which a pressing operation is not performed. However, the present invention is not limited thereto, and the pre-stroke and the distance D1 are not required to be provided. In such a case, as indicated in the section S2 of FIG. 7, immediately after a pressing operation is performed, the elastic deformation of the peripheral wall portion 114 may cause an operation load to increase such that the amount of increase in the operation load per unit operation amount gradually decreases.

What is claimed is:

1. A push switch comprising:

a pressing member including a pressing portion configured to be pressed, and including an elastically deformable peripheral wall portion having a lower end portion and extending downward and outward from an outer periphery of the pressing portion, a movable contact having a dome shape and disposed below the pressing member;

an interposed member disposed between the pressing member and the movable contact, and configured to press the movable contact by receiving and being pressed by the lower end portion of the peripheral wall portion of the pressing member;

a first fixed contact provided in contact with the movable contact; and a second fixed contact configured to be contacted with and separated from the movable contact, wherein the lower end portion of the peripheral wall portion of the pressing member presses the interposed member while the peripheral wall portion is subjected to elastic deformation in response to the pressing portion being pressed, and wherein the interposed member is configured to move toward the movable contact, thereby pressing the movable contact upon receiving a pressing force from the pressing member.

2. The push switch according to claim 1, wherein the pressing member has load characteristics in which the elastic deformation of the peripheral wall portion causes an operation load to increase such that an amount of increase in an operation load per unit operation amount gradually decreases.

3. The push switch according to claim 1, wherein the pressing member further includes an elastically deformable support portion configured to support the peripheral wall portion such that the peripheral wall portion is vertically movable, and wherein the lower end portion of the peripheral wall portion is spaced apart from the interposed member while the pressing portion is in a non-pressed state.

4. The push switch according to claim 1, wherein the interposed member includes a contact portion having a flat plate shape, and configured to receive the lower end portion of the peripheral wall portion, and a first protruding portion that protrudes downward from a center of the contact portion.

5. The push switch according to claim 4, wherein the pressing member further includes an elastically deformable second protruding portion, the second protruding portion having a lower end portion, and being disposed within a space surrounded by the peripheral wall portion to protrude downward from the pressing portion, and wherein the elastic deformation of the peripheral wall portion causes the second protruding portion to be moved downward, and the lower end portion of the second protruding portion contacts the interposed member before the peripheral wall portion is inverted.

6. The push switch according to claim 5, wherein the movable contact is inverted and contacts the second fixed contact, upon the interposed member being pressed by both the lower end portion of the peripheral wall portion and the lower end portion of the second protruding portion.

7. The push switch according to claim 1, wherein the movable contact is made from a dome-shaped metal plate that has a spring characteristic.

* * * * *